US009869465B2

(12) United States Patent
Van Herpen et al.

(10) Patent No.: US 9,869,465 B2
(45) Date of Patent: Jan. 16, 2018

(54) FLOOR COVERING SYSTEM COMPRISING A LIGHTING SYSTEM

(75) Inventors: Maarten Marinus Johannes Wilhelmus Van Herpen, Eindhoven (NL); Oscar Hendrikus Willemsen, Eindhoven (NL); Marcellinus Petrus Carolus Michael Krijn, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 336 days.

(21) Appl. No.: 13/497,289

(22) PCT Filed: Sep. 17, 2010

(86) PCT No.: PCT/IB2010/054212

§ 371 (c)(1),
(2), (4) Date: Mar. 21, 2012

(87) PCT Pub. No.: WO2011/036614

PCT Pub. Date: Mar. 31, 2011

(65) Prior Publication Data

US 2012/0201014 A1 Aug. 9, 2012

(30) Foreign Application Priority Data

Sep. 24, 2009 (EP) ..... 09171208
May 19, 2010 (EP) ..... 10163309

(51) Int. Cl.
*F21S 8/00* (2006.01)
*F21V 33/00* (2006.01)
(Continued)

(52) U.S. Cl.
CPC ..... *F21V 33/006* (2013.01); *E04B 5/46* (2013.01); *E04F 15/02* (2013.01); *E04F 15/10* (2013.01);
(Continued)

(58) Field of Classification Search
CPC ..... F21S 8/022; F21S 8/00; F21V 33/006; F21W 2111/02; E04F 2011/1048; Y10S 362/80; Y10S 362/806
(Continued)

(56) References Cited

U.S. PATENT DOCUMENTS 4,329,739 A 5/1982 Loebner
4,737,764 A * 4/1988 Harrison ..... 362/153
(Continued)

FOREIGN PATENT DOCUMENTS

DE 29508659 U1 8/1995
DE 202004000810 U1 4/2004
(Continued)

OTHER PUBLICATIONS

CRC Handbook of Chemistry and Physics, 69th Edition, 1988-1999, pp. E-208 and 4-406.

*Primary Examiner* — Tsion Tumebo

(57) ABSTRACT

A floor covering system (10) with (a) a PVC-based floor covering (100) and (b) a lighting system (200) arranged to generate light (210). The PVC-based floor covering (100) has a user side (101) and an opposite back side (102). The lighting system (200) is arranged at the back side (102) of the PVC-based floor covering (100). The PVC-based floor covering (100) has a light transmission for light (210) generated by the lighting system (200) in the range of 0.5% to 30%, especially in the range of 1% to 20%.

5 Claims, 5 Drawing Sheets

(51) Int. Cl.

| | |
|---|---|
| ***E04F 15/02*** | (2006.01) |
| ***E04B 5/46*** | (2006.01) |
| ***E04F 15/10*** | (2006.01) |
| *F21V 23/04* | (2006.01) |

(52) U.S. Cl.
CPC .... *F21V 23/0471* (2013.01); *E04F 2290/026* (2013.01); *F21V 23/0442* (2013.01); *F21V 23/0485* (2013.01)

(58) Field of Classification Search
USPC ..... 362/153, 153.1, 559
See application file for complete search history.

(56) References Cited

U.S. PATENT DOCUMENTS

| | | | | |
|---|---|---|---|---|
| 4,754,372 | A * | 6/1988 | Harrison | 362/565 |
| 4,794,373 | A * | 12/1988 | Harrison | 340/286.01 |
| 5,580,156 | A * | 12/1996 | Suzuki | B60Q 7/00 116/63 P |
| 5,848,830 | A * | 12/1998 | Castle et al. | 362/84 |
| 6,116,751 | A * | 9/2000 | Remp | 362/153 |
| 6,330,111 | B1 * | 12/2001 | Myers | G09F 9/33 359/599 |
| 6,504,179 | B1 * | 1/2003 | Ellens | C09K 11/7734 257/88 |
| 6,667,089 | B1 * | 12/2003 | Barker | B29C 70/086 362/147 |
| 6,739,735 | B2 * | 5/2004 | Talamo | E01C 17/00 362/153.1 |
| 6,844,058 | B2 * | 1/2005 | Blum et al. | 428/343 |
| 7,021,786 | B1 * | 4/2006 | Sandor, Sr. | 362/153 |
| 7,125,137 | B2 * | 10/2006 | Kitajima | F21S 8/032 315/294 |
| 7,131,761 | B2 * | 11/2006 | Pipo et al. | 362/559 |
| 7,229,203 | B2 * | 6/2007 | Lath | 362/576 |
| 7,670,022 | B2 * | 3/2010 | Kessler et al. | 362/153 |
| 7,791,683 | B2 * | 9/2010 | Larson | G02B 6/0018 349/62 |
| 2005/0116667 | A1 | 6/2005 | Mueller et al. | |
| 2005/0201087 | A1 | 9/2005 | Ward | |
| 2007/0037462 | A1 | 2/2007 | Allen et al. | |
| 2007/0159814 | A1 * | 7/2007 | Jacobsson | E04F 15/02 362/153 |
| 2007/0263380 | A1 | 11/2007 | Hamar et al. | |
| 2008/0037284 | A1 | 2/2008 | Rudisill | |
| 2008/0254253 | A1 | 10/2008 | Gallager | |
| 2008/0291661 | A1 | 11/2008 | Martin | |
| 2009/0114928 | A1 * | 5/2009 | Messere | B32B 17/10 257/88 |
| 2009/0116241 | A1 * | 5/2009 | Ashoff et al. | 362/253 |
| 2010/0214795 | A1 * | 8/2010 | Salter et al. | 362/488 |

FOREIGN PATENT DOCUMENTS

| | | | |
|---|---|---|---|
| DE | 202007015925 | U1 | 2/2008 |
| EP | 0323682 | A1 | 7/1989 |
| EP | 0959297 | A2 | 11/1999 |
| GB | 2407633 | A | 4/2005 |
| JP | 0856810 | A | 3/1996 |
| JP | 2001295454 | A | 10/2001 |
| JP | 2007154648 | A | 6/2007 |
| WO | 2007033980 | A2 | 3/2007 |
| WO | 2007081254 | A1 | 7/2007 |
| WO | 2007115736 | A1 | 10/2007 |

* cited by examiner

FLOOR COVERING SYSTEM COMPRISING A LIGHTING SYSTEM

FIELD OF THE INVENTION

The invention relates to a floor covering system comprising a floor covering having a user side and an opposite back side, and a lighting system provided at the back side of the floor covering The invention also relates to a floor covering and a floor covering tile for use in the floor covering system.

The invention further relates to a method for providing the floor covering system, and to the use of the floor covering system for way guiding.

BACKGROUND OF THE INVENTION

Lighting on or in floors is known in the art. EP0323682 for instance describes an apparatus for guiding the occupants of a building along a path of travel within the building which comprises modular carpet tiles which are arranged to cover the floor of the structure, with some of the tiles being signal units having a light-transmissive, moulded plastics housing positioned in an opening therein, and having light-emitting diodes positioned in the housing. The light-emitting diodes are energised via an electrical cable, and thereby provide a visually discernable pathway on the floor.

Further, also textiles comprising optical fibres are known in the art. US20070037462 for instance describes a method for manufacturing a distributed optical fibres scrim comprising functional optical fibres, the functional optical fibres scrim thus manufactured, and composites in which an optical fibres scrim is incorporated. This document describes a variety of textile scrims, particularly adhesively bonded non-woven scrim materials, each comprising at least one optical fibre with a continuous path across at least the length or width of the fabric. Such optical fibres scrims may be useful as sensor components (for example, as a detector of breakage, strain, pressure, or torque), as illumination components (for example, in a variety of light-providing applications), or as data-distribution components, either alone or in combination with other materials, such as fabrics, films, foams, and the like.

U.S. Pat. No. 4,754,372 describes an illuminable covering of a textile material having a fibrous face with at least one light source connected to the back of the textile material. A plurality of light-transmissive fibers are connected to the light source and emanate therefrom, with their free end portions terminating adjacent the fibrous face of the textile material for transmitting light thereto when the light source is energized. In an embodiment, the textile material is a floor covering material such as a carpet or rug.

The use of electronic components in for instance carpets is known in the art. WO2007033980 for instance describes such carpet, as well as a method for equipping a carpet with electronic components. In order to create a method which ensures that the electronic components can be applied to the carpet in an efficient and accurately locatable manner, the electronic components that are fixedly joined to a support material are glued to the carpet with the aid of the supports.

U.S. Pat. No. 4,794,373 describes an apparatus for visually guiding the occupants of a structure in a path of travel along the floor within the structure is provided. This apparatus is comprised of a carpet overlying the floor, and a lighting strip positioned underneath the carpet. The lighting strip comprises an elongate ribbon, with a group of laterally spaced-apart electrical conductors encased in and extending longitudinally of the ribbon of sheet material. A series of light-transmissive plastic housings are connected to and arranged longitudinally along a common outer surface of the ribbon of plastic sheet material. Light-emitting means are positioned within each of the housings, and are electrically connected to predetermined ones of the group of electrical conductors encased in the ribbon of sheet material. The carpet has holes extending therethrough which are arranged in a series corresponding to the series of light-transmissive housings on the lighting strip. The housings are positioned in the holes of the carpet so that when the light-emitting means positioned within the housings are energized, a visually discernible pathway appears along the face of the carpet.

SUMMARY OF THE INVENTION

A disadvantage of many of the prior art is for instance that the light sources or their housing penetrate the carpet. This may be undesired by users for reasons of aesthetics, because there is no "real broadloom" covering and there may be no constant covering feel and sight. Additionally cleaning of the system may become more difficult, because the lighting system may need to be cleaned independent of the carpet. Another problem of prior art may be that the cost is too high, and this cost is strongly increased by the housing required for the light sources. Further, it may add to the complexity of the systems, which makes installation of the prior art light sources difficult. Another disadvantage of prior art is that the lighting pattern cannot easily be changed after the system has been installed.

There is a desire to provide coverings with lighting functions, but there is also a desire to be flexible when arranging the covering and the lighting on a floor.

Further, there is also a desire to provide a covering that is preferably at least one or more of robust, cheap, widely usable and widely accepted.

It has been found that floor coverings according to the present invention, being floor coverings that have a light transmission for light generated by the lighting system in the range of 0.5% to 30%, and that are chosen from the group consisting of PVC floorings and laminate floorings, may fulfil one or more of these criteria. In the context of this invention, a flooring is a finishing material for application over a floor surface to provide a walking surface. A PVC flooring is a flooring that comprises (or is based on) polyvinyl chloride (PVC). A laminate flooring is a flooring that comprises (or is based on) laminate flooring tiles or panels, a laminate flooring tile or panel being a flooring product comprising a fused multi-layer structure.

Additionally, the advantage of floor covering tiles is that they may easily be replaced, which may make it also possible to replace or repair a lighting system that is installed below the tile(s).

Hence, it is an aspect of the invention to provide an alternative floor covering that may allow a lighting function, as well as an alternative floor covering tile, that may also allow a light output function (especially lumination), which preferably further at least partly obviate one or more of above-described drawbacks.

In a first aspect, the invention provides a floor covering system comprising (a) a floor covering having a user side and an opposite back side, and (b) a lighting system (comprising one or more light sources) arranged to generate light, and provided at the back side of the floor covering, wherein the floor covering has a light transmission for light generated by the lighting system in the range of 0.5% to 30%, especially in the range of 1% to 20%, and wherein the floor covering is chosen from the group consisting of PVC floorings and laminate floorings.

In this way, a robust floor covering system may be provided, substantially based on state of the art floor covering producing processes. However, here the floor covering system also provides the option of providing light, while on the other hand, the transmissivity of the floor covering is chosen such that the lighting system is not visible when no light is emitted. Hence, the floor covering system may produce light, but the light sources behind the floor covering are not visible. Preferably, the transmission is in the range of 0.5% to 20%, such as 1% to 20%. Especially, the transmission is equal to or smaller than 15%, such as equal to or smaller than 10%, like for instance 1% to 10% or 1% to 5%. Hence, the indicated transmission range may on the one hand provide enough transmission through the floor covering, for instance to make the light effect even visible under typical office lighting conditions, especially assuming state of the art LEDs, preferably solid state LEDs, but on the other hand, substantially prevents visibility of elements (such as for example the light source) under the floor covering. Visibility of the floor or other elements under the floor covering may especially not be desired, because the light source (or other elements, like electric wires, reflective foil, a padding) may no longer be hidden. The principle presented here may also be indicated as "hide light": the light sources may be hidden and not visible to a user of the floor covering system, while the light generated thereby is visible to the user.

The transmission or light permeability can be determined by providing light at a specific wavelength with a first intensity to the material and relating the intensity of the light at that wavelength measured after transmission through the material, to the first intensity of the light provided at that specific wavelength to the material (see also E-208 and E-406 of the CRC Handbook of Chemistry and Physics, $69^{th}$ edition, 1088-1989).

Transmission is measured of light travelling through the floor covering (tile) from the back side to the user side. The back side is the part of the floor covering (tile) that is in general arranged on the floor (optionally with an adhesive such as glue). The user side is the front side, and is the side that is visible to users when the floor covering is arranged on a floor. The intensity of the light downstream of the top face or user side is related to the intensity of the light upstream of the floor covering, i.e. at the back side. The light shed on the back side for determining transmission is preferably directed on the back side under normal incidence and the total integrated light emission on the other side of the floor covering is measured.

An additional advantage of the present invention may be that the floor covering is protecting the lighting system that is underneath. Thus, when people are walking over the floor covering system, the floor covering may protect the lighting system from damage. Additionally, this may eliminate the need to use a protective housing for the lighting system, which may make the lighting system cheaper to produce.

Such floor covering system may be used in nearly any type of rooms or areas, such as living rooms, kitchens, bed rooms, play rooms, mud rooms, laundry rooms, aisles, shops, indoor training areas, garages, offices, schools, hotels, libraries, hospitals, transport vehicles (trains, boats, etc.), etc.

Such floor covering systems are arranged to provide floor light, i.e. light emanating from the floor covering when the lighting system is switched on. The floor light may be used to light rooms or areas, but may also be used as functional or decorative lighting. The floor light may alternatively or additionally also be used to provide information, like commercial information (trademarks, trade names, prices, etc.), other information (like time, temperature, date), and way finding information, such as directions for finding shops, rooms, entrances, exits, or areas. Especially, the floor covering system may be used to provide emergency way finding. Hence, the invention also provides the floor covering system as described herein for way guiding, especially for emergency way guiding. Therefore, such floor covering system may in an embodiment also be used to provide information by creating a lighting pattern on the floor (like an arrow, etc.).

The floor covering system according to the invention may comprise a wall-to-wall (or fitted) floor covering or a floor covering comprising a plurality of floor covering tiles. Hence, in an embodiment, the floor covering may comprise a plurality of PVC flooring tiles or a plurality of laminate flooring tiles (panels). The use of tiles may be advantageous, since in case a light source may need to be replaced, repaired or removed, only the relevant tile(s) may have to be removed (temporarily). In general, the tiles are arranged adjacent from each other, such that a closed floor covering is obtained. PVC and laminate floor covering tiles often have connectors, which allow plugging one tile in another tile. In this way, tiles can be "clicked" together; for instance, jigsaw-type of structures may be applied. Further, the lighting system may comprise a plurality of lighting units. This may provide freedom in where arranging light sources and may reduce use of material.

The lighting system in general comprises a plurality of light sources, especially LED (light emitting diode) light sources. The term "plurality of light sources" may refer to 2 or more light sources (especially LEDs), especially 2 to 100,000, for instance 2 to 10,000, like 4 to 300, such as 16 to 256. Hence, the lighting system may comprise a plurality of LEDs, such as 2 to 10,000 LEDs/$m^2$, especially 25 to 2,500 LEDs/$m^2$.

Note that the plurality of LEDs may be distributed over a plurality of lighting units. Thus, a lighting system may comprise one or more lighting units. In general, the lighting system will comprise a plurality of lighting units, depending upon the area to which the floor covering system is applied. The lighting units may be adjacent, or may be arranged at non-zero distances from each other. The lighting units may be powered independently or dependently. The lighting units may for instance be electrically interconnected. A controller (see below), may control one or more lighting units individually. The controller may (also) control one or more light sources individually.

For example, a 10 meter corridor in an office might comprise 10 tiles corresponding with 10 lighting units, each lighting unit comprising around 20 to 80 mono-colour LEDs, for instance for outlining an arrow.

Therefore, the term "lighting system" may also refer to a plurality of lighting units. Further, the invention does not exclude that in a floor covering system comprising a plurality of tiles arranged on a lighting system comprising a plurality of light sources, not each tile is arranged over one or more light sources. Likewise, the invention does not exclude that in a floor covering system comprising a plurality of tiles arranged on a lighting system comprising a plurality of lighting units, not each tile is arranged over one or more lighting units.

The light source(s) may be any light source, such as a small incandescent lamp or a fiber tip or fiber irregularity (arranged to let light escape from the fiber, which embodiment has the advantage that it is relatively cheap), but may especially be a LED (light emitting diode). A specific advantage of using LEDs is that they are relatively small and may thereby fit better in a recess in a substrate (see also below). As mentioned before, a total thickness of the lighting system below 1 mm is preferred, and this may only be achieved with LEDs. The term LED may refer to OLEDs, but especially refers to solid state lighting. Unless indicated otherwise, the term LED herein further refers to solid state LEDs. Especially, the light source is part of a lighting system comprising a plurality of light sources.

Solid state LEDs as light source(s) is especially desired because of their small dimensions. Such light sources with state of the art technique may be less than 1 mm thick, even in the range of about 0.2 mm (excluding a support structure of 0.5 mm to 1 mm thickness, such as a printed circuit board (PCB), or smaller. When arranging such light source (for example having a total thickness of 1 mm including support structure) on a floor, the floor covering may be arranged over the light source without substantial influence of the (presence of the) light source on the (local) surface height of the floor covering.

Nevertheless, it may be preferred to take into account the presence of a light source under the floor covering and include a means that may level the lighting system.

In yet another embodiment, the invention provides a floor covering for use in the floor covering system, having one or more recesses at the back, in which at least part of the lighting system can fit. For instance, the recess(es) may be arranged to host at least part of a light source, or at least parts of a plurality of light sources, but the recess(es) may also be arranged to host at least part of a lighting unit, or at least parts of a plurality of lighting units, respectively. Hence, in an embodiment the lighting unit may at least partly be arranged in one or more recesses at the back side of the floor covering (wall-to-wall or tiled).

In a specific embodiment, the floor covering system may further comprise an auxiliary layer, such as a levelling layer and/or an adhesive layer, arranged between at least part of the lighting system and at least part of the floor covering. This auxiliary layer may be arranged between lighting units. It may also be arranged between light sources that may protrude from a substrate, such as a PCB. The auxiliary layer may also be arranged on the entire lighting unit or lighting system. Especially, the auxiliary layer may be selected from the group consisting of a levelling layer and an adhesive layer.

When the auxiliary layer is arranged over one or more light sources, the auxiliary layer may be chosen to be transmissive. For instance, a transmissive foil or a transmissive adhesive may be used. The levelling layer may also be chosen such that it can (plastically) deform to shape itself over the light source(s) (and/or lighting system). The auxiliary layer may also be arranged in such a way, that the light source(s) (or at least emitting surface(s) thereof) are free from the auxiliary layer. For instance, the levelling layer may comprise one or more holes, arranged to allow light from one or more light source travel through.

In an embodiment, the levelling layer is attached to part of the lighting system. For instance, each lighting unit may comprise such levelling layer, attached to at least part of its top side. Hence, in an embodiment, the levelling layer may be part of the lighting system. The levelling layer may comprise plastic, felt, PCB material (i.e. insulating material such as poly tetra fluoroethylene or FR-4), or other materials.

Alternatively or additionally, a lighting unit comprising a substrate with one or more light sources, may also comprise at its top face one or more cavities or recesses for hosting the one or more light sources. The one or more light sources may be partly or completely recessed in the one or more cavities/recesses, respectively. When the one or more light sources and/or other electrical components, are hosted in one or more recesses, a substantially flat lighting system may be achieved.

Hence, in an embodiment, the invention also provides a lighting system that preferably comprises a printed circuit board (PCB) with one or more recesses, especially for hosting one or more light sources. The one or more recesses may be arranged to host one or more light sources and/or one or more other electrical components, such as electrical connections, resistors, transistors, power source(s), controller(s), etc. A specific embodiment is a PCB as substrate, with light sources and/or other (electronic) components of the lighting system embedded in a levelling layer on the PCB (substrate). This levelling layer may especially (also) be PCB material. The levelling layer may comprises openings or recesses, wherein at one or more parts of the lighting system may be arranged, especially the light sources. Such PCB (substrate) with (PCB) levelling layer can in an embodiment be considered as a laminate, such as a PCB laminate. The advantage of using PCB material as levelling layer is that the recessed structure may be manufactured in the manufacturing process of PCB laminates.

Conducting layers in PCBs are typically made of thin copper foil. Insulating layers (dielectrics) are typically laminated together with epoxy resin pre-preg. Dielectrics may for instance be chosen from the group consisting of polytetrafluoroethylene, FR-4, FR-1, CEM-1 or CEM-3. Well known pre-preg materials used in the PCB industry are FR-2 (phenolic cotton paper), FR-3 (cotton paper and epoxy), FR-4 (woven glass and epoxy), FR-5 (woven glass and epoxy), FR-6 (matte glass and polyester), G-10 (woven glass and epoxy), CEM-1 (cotton paper and epoxy), CEM-2 (cotton paper and epoxy), CEM-3 (woven glass and epoxy), CEM-4 (woven glass and epoxy), CEM-5 (woven glass and polyester).

Preferably, the total height of the light sources, and even more preferably the total height of the lighting system is at maximum 1 mm, preferably less, such equal to or less than about 0.7 mm, especially 0.5 mm or less, such as 0.2 mm to 0.4 mm, like 0.3 mm.

The lighting system is preferably made as thin as possible and is preferably very flat, because otherwise the outlines of the lighting system may be visible through the floor covering. Flatness may for instance achieved by the herein described levelling layer. Since especially PVC- and laminate flooring tiles can be very sensitive to uneven parts of the floor (risk of breaking the tile in time), a small height and/or a flat lighting system are preferred.

In another embodiment, the lighting system comprises openings through the entire lighting system such that the floor or wall underneath the lighting system is exposed through these openings. The advantage of this approach is that no adhesion promoting layer may be necessary, because the floor covering may adhere directly to the floor.

The floor covering system may further comprise a controller, which may be arranged externally from the floor covering system but which may also be integrated in the floor covering system, arranged to control the lighting system, and especially the individual light sources of the lighting system. In embodiments wherein the floor covering system comprises a plurality of lighting units, the floor covering system may comprise one or more controllers. In general, there will be one central controller, herein further indicated as "controller". For larger floor areas, optionally a plurality of independent or dependent controllers may be used. Hence, in an embodiment, the floor covering system further comprises a controller arranged to control the lighting system; i.e. the controller is arranged to control the light generated by the lighting system. In this way, also for instance information may be provided, like arrows indicating in a specific direction, or commercial information. One or more of colour, on/off state, intensity, pattern shape and information content of the light may be variable and may be controlled by the controller. A controller may be integrated in the lighting units. For example, by having a controller on each board (or lighting unit), the different boards may communicate with each other, for instance to determine the on/off states, etc.

Further, the floor covering system may comprise a sensor, wherein the controller is arranged to control the light of the lighting system in response to a sensor signal of the sensor. Hence, in an embodiment one or more of colour, on/off state, intensity, pattern shape and information content of the light may be dependent on a sensor signal of a sensor (such as a touch or approach sensor), wherein the sensor is arranged to sense an object on or in the vicinity of the floor covering, and wherein the controller is arranged to control or more of colour, on/off state, intensity, pattern shape and information content of the light in dependence of the sensor signal. Therefore, in yet another embodiment, the floor covering system further comprises a sensor, such as a touch or an approach sensor, which may be arranged externally from the floor covering system but which may also be integrated in the floor covering system.

In yet a further embodiment, the invention provides the floor covering system or the lighting system (designed for use in such floor covering system) in combination with a sensor and the controller, wherein the sensor is arranged to provide a sensor signal when the sensor is approached or touched, and wherein the controller is arranged to control one or more parameters selected from the group consisting of a lighting parameter (such as one or more of colour, colour distribution, light intensity, light intensity distribution, blinking frequency, etc.) of the floor covering system or the lighting system, respectively, pattern shape of the light, and information content provided by the light. Patterns or information will in general be provided by a plurality of light sources.

The invention also provides in a further aspect a floor covering per se, for use in the floor covering system according to the invention, having a light transmission for light in the range of 0.5% to 30%, especially in the range of 1% to 20% (see also above), wherein the floor covering is chosen from the group consisting of PVC floorings and laminate floorings.

According to a further aspect, the invention provides a floor covering tile chosen from the group consisting of PVC flooring tiles and laminate flooring tiles (panels), having a user side and an opposite back side, and having a light transmission for light in the range of 0.5% to 30%, especially in the range of 1% to 20% (see also above). In a specific embodiment, the floor covering tile may further comprise a lighting unit arranged at the back side of the floor covering tile, wherein the floor covering tile and the lighting unit are integrated. Such tile may be used as one unit that advantageously combines lighting properties and flooring covering properties in one unit. Such unit may be replaced in one action.

In another alternative embodiment the floor covering tile has a recess in which (part of) the lighting system fits, such that there may be no need for a levelling layer during installation. In this way, (part of) the lighting system may easily installed or replaced (at exactly the same location). Hence, in an embodiment of the invention, the lighting unit is at least partly arranged in one or more recesses at the back side of the floor covering tile. Further, the invention also provides floor coverings (per se) for use in the floor covering system according to the invention, having one or more recesses arranged at the back side of the floor covering and arranged to host at least part of the lighting system.

In a specific embodiment, the floor covering is a PVC flooring that comprises a filler material having a refractive index in the range of 1.4 to 1.65, such as 1.5 to 1.6. Such index of refraction may match relatively well with the index of refraction of the PVC. Preferably, the index of refraction of the filler material matches with the index of refraction of PVC (i.e. preferably less than about 20%, more preferably less than about 10%, even more preferably less than about 5%, difference with the index of refraction of PVC) This may improve transmission and reduce light loss. In another embodiment, the filler material may comprise one or more materials selected from the group consisting of calcium carbonate, aluminium trihydrate, polycarbonate, and glass, especially aluminium trihydrate. Optionally, zeolites may be applied. In a specific embodiment high purity calcium carbonate is applied.

According to yet a further aspect, the invention provides a method for providing the floor covering system of the invention, comprising arranging a lighting system on a floor, optionally arranging an auxiliary layer, such as a levelling layer on at least part of the lighting system, and arranging the floor covering, optionally in the form of a plurality of floor covering tiles, over the lighting system.

Terms like "below", "above", "top", and "bottom" relate to positions or arrangements of items which would be obtained when the floor covering system, floor covering or floor covering tiles are arranged substantially flat on a substantially horizontal surface with the user side and back side of the floor covering (tiles) and/or top side and bottom side of the lighting system substantially parallel to the substantially horizontal surface. However, this does not exclude the use of the floor covering system in other arrangements, such as against a wall, or in other (vertical) arrangements.

The terms "upstream" and "downstream" relate to an arrangement of items or features relative to the propagation of the light from a light generating means (here the lighting system, especially the light source, such as the LED), wherein relative to a first position within a beam of light from the light generating means, a second position in the beam of light closer to the light generating means is "upstream", and a third position within the beam of light further away from the light generating means is "downstream".

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION OF THE EMBODIMENTS

Figure 1:
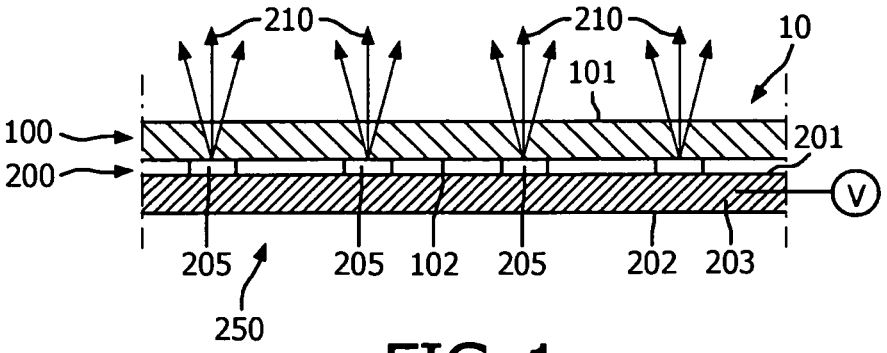
FIG. 1 schematically depicts an embodiment and the floor covering system according to the invention.

FIG. 1 schematically depicts an embodiment of a floor covering system 10 according to the present invention. The floor covering system 10 comprises (a) a floor covering 100 and (b) a lighting system 200 arranged to generate light 210.

The floor covering 100 has a user side 101 and an opposite back side 102. The lighting system 200 has a top side 201 and a bottom side 202. The lighting system 200 is arranged at the back side 102 of the floor covering 100. As can be seen in FIG. 1, the top side 201 of the lighting system 200 and the back side 102 of the floor covering 100 are facing each other. The back side 102 may also be indicated as illumination side. The lighting system 200 in this embodiment comprises a plurality of light sources 205, such as LEDs. The lighting system 200 is arranged to generate light 210 (when switched on). In this embodiment, the lighting system 200 comprises one lighting unit 250 (i.e. the lighting unit is the lighting system); in general the lighting system 200 may comprise a plurality of lighting units 250 (see below). The lighting system 200 may be powered by an external power source (indicated with "V").

The floor covering 100 has a light transmission for light 210 generated by the lighting system 200 in the range of 0.5% to 30%, especially in the range of 1% to 20%. In this way, an observer/user perceiving the user side 101 of the floor covering 100 will essentially not see the lighting system 200 or other items behind the back side 102 of the floor covering 100. The observer will observe the floor covering 100 as "normal" floor covering 100. However, when the lighting system 200 provides light 210, this light 210 is observed by the observer. The source of light is hidden; the light itself is perceived.

The floor covering 100 is chosen from the group consisting of PVC floorings and laminate floorings.

The invention is also directed to the floor covering 100 per se, having user side 101 and opposite back side 102, and having a light transmission for light 210 in the range of 0.5% to 30%, especially in the range of 1% to 20%, wherein the floor covering 100 is chosen from the group consisting of PVC floorings and laminate floorings. The floor covering 100 may be a PVC flooring comprising a filler material. The filler material may for instance comprise one or more materials selected from the group consisting of calcium carbonate, aluminium trihydrate, polycarbonate, and glass. The invention is also directed to the lighting system 200 per se.

The lighting system 200 in general comprises a substrate or support, indicated with reference 203, which substrate or support 203 comprises the light source(s) 205. For instance, support 203 may be a PCB (printed circuit board). To such PCB, LEDs may be provided.

Figure 2A:
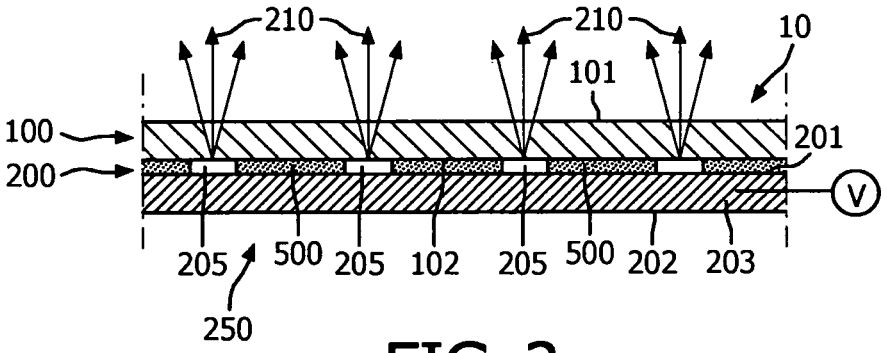
FIGS. 2*a* to 2*f* schematically depict embodiments and variants thereof of the floor covering system according to the invention.
Figure 2B:
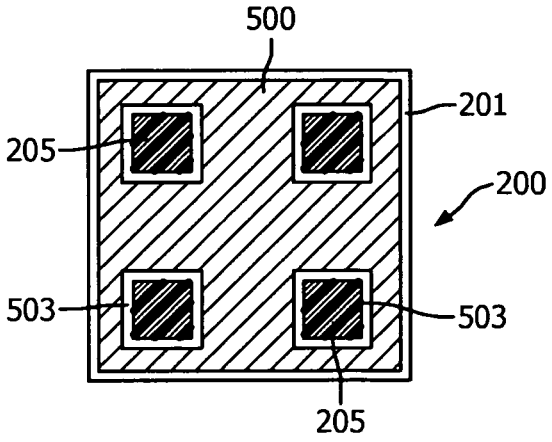
Figure 2C:
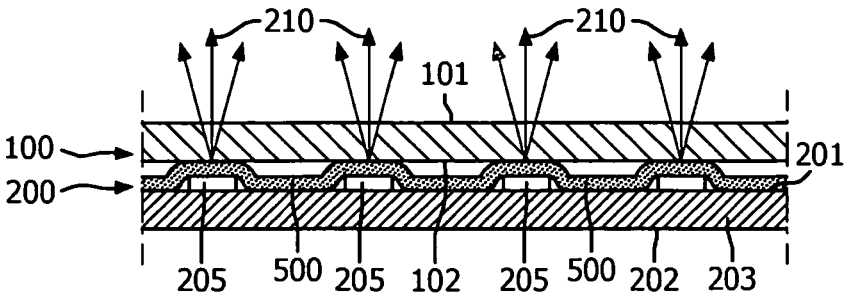

FIGS. 2*a* to 2*c* schematically depict non-limiting means/embodiments with an auxiliary layer, for instance to smooth or level the lighting system 200. These embodiments show an auxiliary layer 500, arranged between at least part of the lighting system 200 and the floor covering 100. The auxiliary layer may for instance comprise an adhesive. The auxiliary layer may also be arranged as levelling layer. In FIG. 2*a*, the auxiliary layer 500 is substantially only present between the light sources 205 and not over the light sources 205. FIG. 2*a* schematically depicts a cross-section. To illustrate the terms "downstream" and "upstream" in relation to FIG. 2*a*: user side 101 is downstream of back side 102; back side 102 is upstream of user side 101.

FIG. 2*b* schematically depicts a top view of the embodiment of FIG. 2*a*, however without the floor covering 100. It can be clearly seen that the levelling layer 500 has openings, indicated with reference 503, for the light sources 205. Hence, the lighting system 200 may provide light 210, without substantial absorption of the levelling layer 500, since the levelling layer 500 has openings 503 to allow light 210 travel in the direction of the floor covering 100.

FIG. 2*c* schematically depicts an embodiment wherein the auxiliary layer 500 is also arranged over the light sources 205. The auxiliary layer may be chosen to be transmissive for light 210 of the lighting system 200.

The levelling layer 500 may be part of the lighting system 200, i.e. it may be a layer attached to the lighting system 200. For instance, it may be a laminate of support 203 (such as a PCB) and levelling layer 500. The levelling layer may in an embodiment be made of PCB material.

Figure 2D:
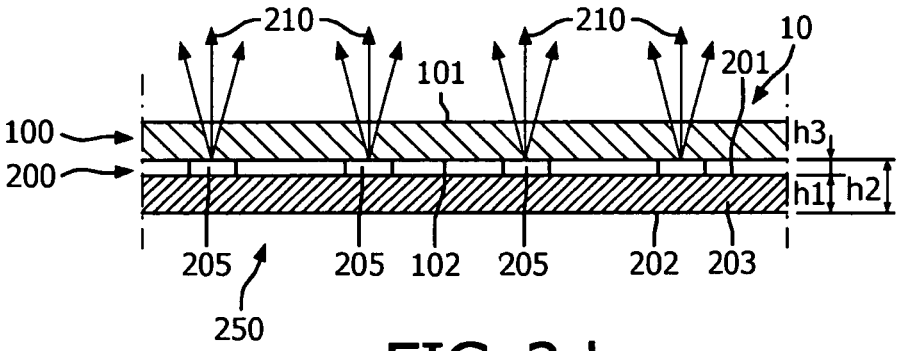

FIG. 2*d* is used to illustrate some parameters of the lighting system 200. The total height of the lighting system is indicated with h2; the height of the support 203 is indicated with h1 and the height of the light source(s) 205, if protruding from the top side 201 of the lighting system 200 (or support 203), is indicated with h3; i.e. h2=h3+h1. The total height h2 may for instance be in the range of about 1 mm.

Figure 2E:
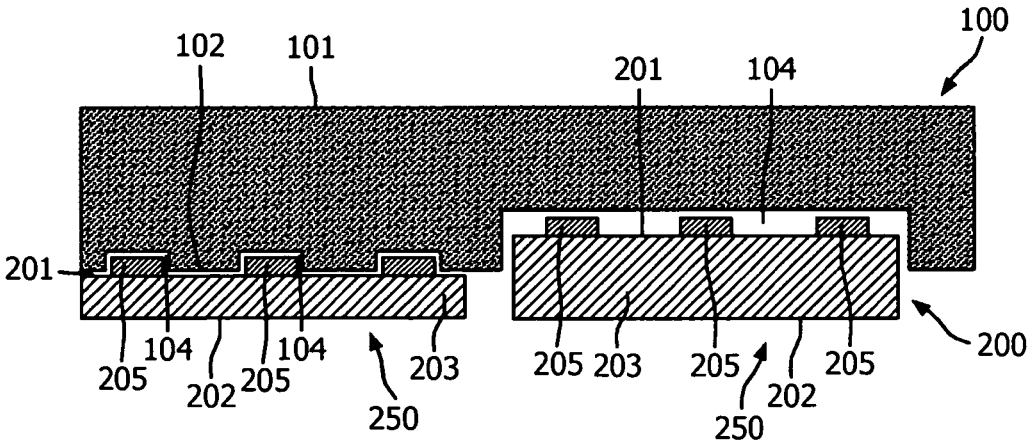

FIG. 2*e* schematically depicts an embodiment wherein the floor covering 100 comprises recesses 104, also indicated as covering recess. Variants are schematically depicted, wherein the left part of the Figs. shows a plurality of recesses, arranged to host at least part of the lighting system 200, more precisely at least part of the lighting unit 250 drawn on the left. More precisely, in this variant the recesses 104 are arranged to host the light sources 205 of the (left) lighting unit 250. At the right, a variant of recess 104 is shown, also arranged to host at least part of the lighting system 200, more precisely in this variant at least part of the (right) lighting unit 250. More precisely, in this variant, the recess 104 is arranged to host the (right) lighting unit 250.

Figure 2F:
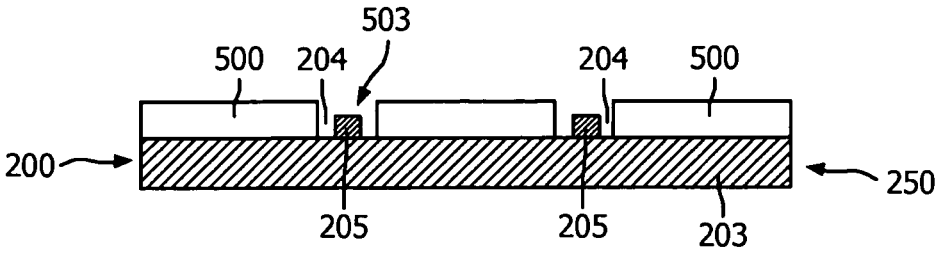

FIG. 2*f* depicts a specific variant of the lighting system 200 schematically depicted in FIG. 2*a*. The lighting system 200 comprises a substrate 203, which is especially a PCB. Light sources 203 and/or other (electronic) components of the lighting system 200 are embedded in levelling layer (indicated as auxiliary layer 500), in recesses 204 (these recesses 204 may also be indicated as openings 503). In this way, a flat lighting system 200 may be provided. The levelling layer may also be PCB material, laminated to the PCB substrate. Hence, in this way a PCB (Printed Circuit Board) with one or more recesses 204 may be obtained, especially for hosting one or more light sources 205. The one or more recesses 204 may be arranged to host one or more light sources 205 and/or one or more other electrical components, such as electrical connections, power source(s), controller(s), etc. The lighting unit 250 schematically depicted in FIG. 2*f* may be considered a laminate.

Figure 3A:
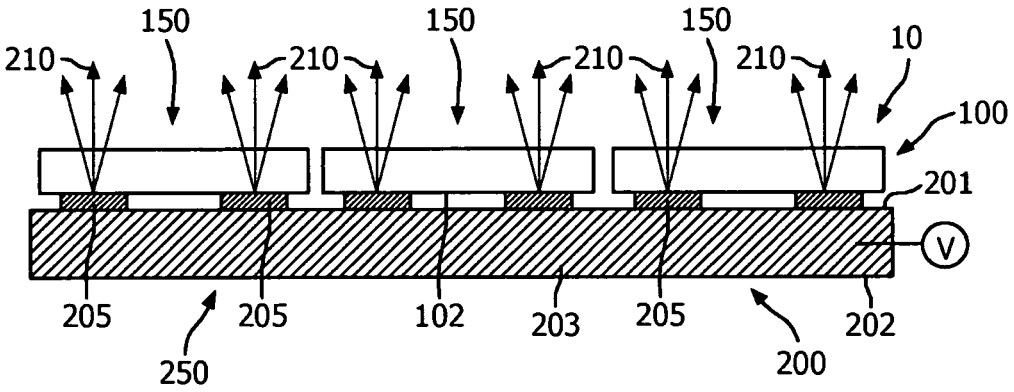
FIGS. 3*a* to 3*b* schematically depict embodiments and variants thereof of the floor covering system according to the invention.
Figure 3B:
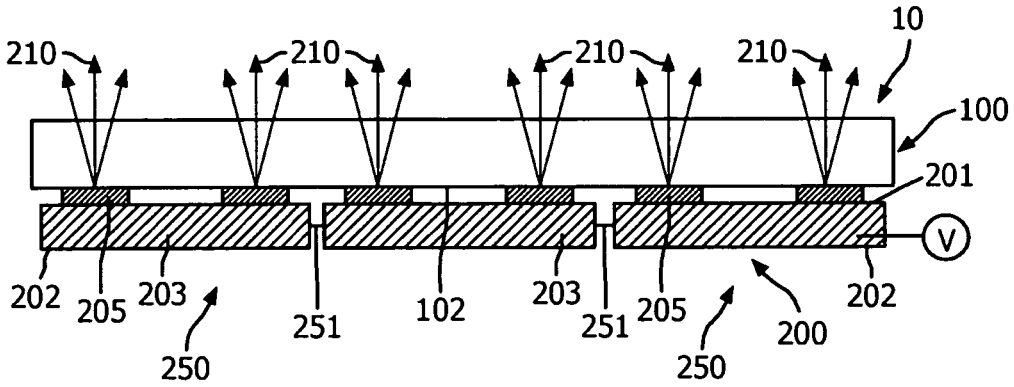

FIG. 3*a* schematically depicts an embodiment wherein the floor covering 100 comprises a plurality of floor covering 50. FIG. 3*b* schematically depicts an embodiment wherein the lighting system 200 comprises a plurality of lighting units 250. FIG. 3*b* by way of example also shows (optional) electric connections 251 between (adjacent) lighting units 250. Note that the floor covering system 100 may also comprise a plurality of floor covering tiles 150 and a plurality of lighting units 250. In an embodiment, the number of floor covering tiles 150 may be larger than the number of lighting units 250. In such embodiment, when lighting units 250 may not be adjacent, (also) an auxiliary layer may be arranged between the lighting units 250. A unit may for instance have dimensions like 5 cm to 50 cm length and width, and 0.1 mm to 1 mm height.

Figure 4:
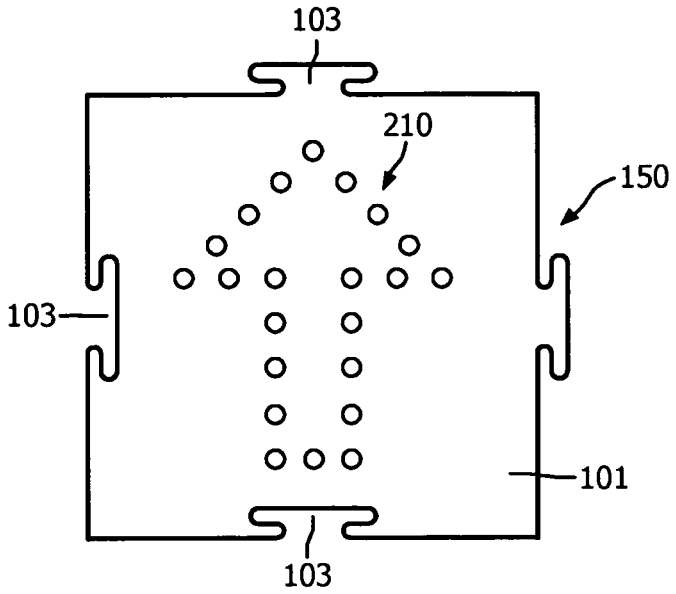
FIG. 4 schematically depicts an embodiment and variants thereof of the floor covering system according to the invention.

FIG. 4 schematically depicts some variants of the invention. Here, the floor covering tile 150 is a PVC floor covering tile that comprises connectors 103. These may be used to connect multiple tiles 150 and form a "closed" tile area, i.e. a PVC flooring. Further, by way of illustration, light 210, emanating from the user side 101, in the form of a symbol is depicted.

Figure 5:
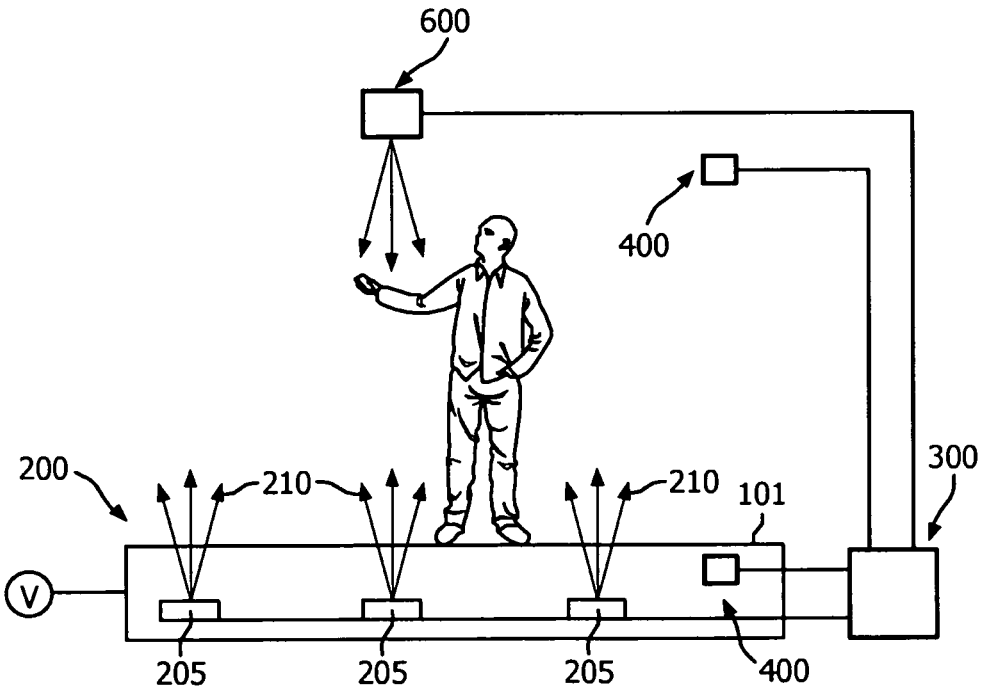
FIG. 5 schematically depicts an embodiment and variants thereof of the floor covering system according to the invention.

FIG. 5 schematically depicts an embodiment of the floor covering system 10 further comprising a controller 300 arranged to control the lighting system 200, more precisely the light 210 that may be generated by the lighting system 200. The controller 300 may be arranged external from the lighting system, but may also be integrated in the lighting system 200. The controller 300 controls the one or more light sources 205. Optionally, the floor covering system 10 may further comprise a sensor 400. The controller 300 may then be arranged to control the light 210 of the lighting system 200 in response to a sensor signal of the sensor 400. The term "sensor" may also relate to a plurality of sensors. Such plurality of sensors may for instance be arranged to sense the same parameter (like touch of a user) at different locations, or to sense different parameters (like touch of a user and smoke, respectively).

Figure 6A:
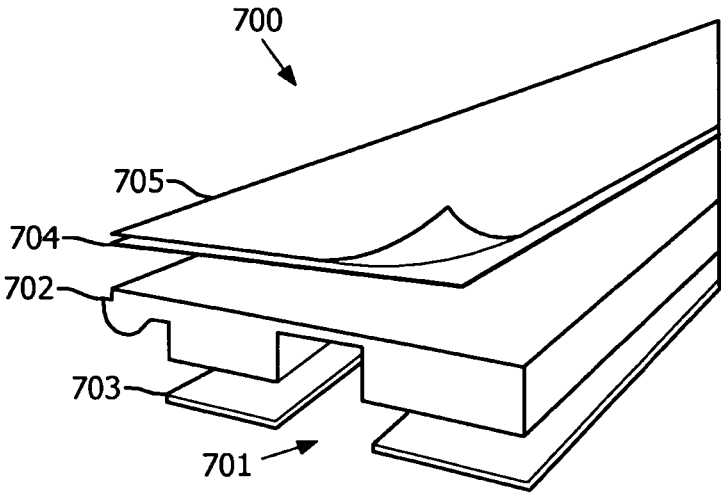
FIG. 6*a* schematically depicts an embodiment of a laminate flooring tile for use in the flooring covering system of the invention.
Figure 6B:
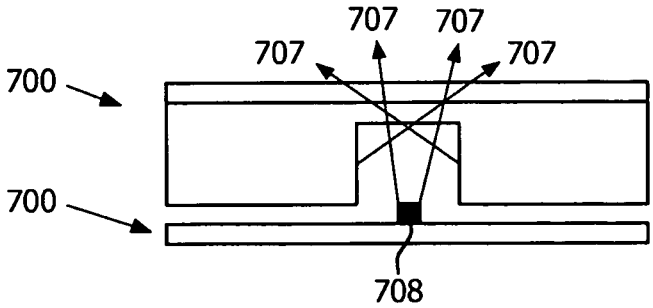
FIG. 6*b* schematically depicts a lighting system to be placed below the laminate flooring tile when used in floor covering system according to the invention.

FIG. 6*a* schematically depicts an embodiment of a laminate flooring tile for use in the floor covering system of the invention. The laminate flooring tile 700 comprises recess 701, which penetrates through the inner core layer 702 and the sound inhibitor layer 703 (which is an example of an optional backing layer). The recess 701 does not penetrate through the photographic layer 704 and protective layer 705. This allows the lighting system 706, comprising the light source 708, to be placed below the laminate flooring tile 700 when used in a floor covering system according to the invention, as shown in FIG. 6*b*, so that light 707 can penetrate through the laminate flooring tile 700. When the lighting system 706 is placed below the laminate flooring tile 700, the part of the laminate flooring tile 700 that remains on top of the recess 701 is preferably separated from the top of the light source 708 by a distance of at least 1 mm, more preferably at least 3 mm, to prevent direct contact between the laminate flooring tile 700 and the light source 708, which could damage the light source 708, when pressure is exerted on the laminate flooring tile 700, for example by people standing or walking on the floor covering system.

The recess 701 may be filled with a transparent or at least light transmissive material. The advantage of this approach is that the robustness of the laminate flooring tile 700 is improved. For example, a suitable material may be a polymer material, such as PVC, MAMA, PE, PP, or a silicone rubber. When the lighting system 706 is placed below the laminate flooring tile 700 wherein the recess 701 is filled with a transparent or at least light transmissive material, the transparent or at least light transmissive material is preferably separated from the top of the light source 708 by a distance of at least 0.5 mm, to prevent direct contact between the transparent or at least light transmissive material and the light source 708, which could damage the light source 708, when pressure is exerted on the laminate flooring tile 700, for example by people standing or walking on the floor covering system.

The recess 701 may also not fully penetrate through the inner core layer 702 (in other words, a thin layer of inner core material remains) in order to improve the robustness of the laminate flooring tile 700. This remaining layer of inner corer material has to have a thickness that allows light 707 to be transmitted, preferably a thickness of less than 1 mm, more preferably less than 0.5 mm. A laminate flooring tile with such a recess may be manufactured by providing a laminate flooring tile, providing a recess at the back side of the laminate flooring tile, having a depth so that a thin layer of inner core material remains, the thin layer having being light transmissive, and optionally filling the recess with a light transmissive material.

The recess 701 may be used as a mixing cavity to mix the colors of a plurality of LEDs with different colors. Preferably the colors are generated by an RGB LED. The advantage of this approach is that the recess 701 not only provides ease of installation, but also provides the optical function of mixing light.

In case the recess 701 is used as a color mixing cavity, it may have a pre-determined shape so that this pre-determined shape is visible on the front side of the laminate flooring tile 700 when the lighting system 706 is turned on. The recess 701 may for example have a rectangular shape.

The recess 701 may contain a plurality of LEDs. In one example, the recess 701 has the shape of an arrow, and contains 80 LEDs in various places within the recess 701. In this way, a uniformly illuminated arrow will be visible on the front side of the laminate flooring panel 700 when the LEDs are turned on.

The laminate flooring tile 700 may be provided with a plurality of recesses 701 in order to allow flexibility in placement of a lighting system. This means that light sources are not installed at every recess, but instead only a few recesses are used. This embodiment may for example be used to provide a line of light sources near the walls of a room.

Alternatively, instead of having the recess 701, the entire inner core layer 702 may be made from a light transmissive material.

To improve alignment between the lighting system 706 and the laminate flooring tile tile 700, the lighting system 706 may be attached to the laminate flooring tile 700, for example by using an adhesive, but preferably by using a 'click' connection. In this way the lighting system 706 may still be moved and placed freely, but the lighting system 706 is easier to align to the laminate flooring tile 700.

Electric power may be distributed through the laminate flooring tile 700. To achieve this, the laminate flooring tile 700 may be provided with a conductor arrangement on or through the laminate flooring tile 700. Electric connections are made between this conductor arrangement and the lighting system 706 during installation, for example by clicking the lighting system 706 onto the laminate flooring tile 700. The advantage of this approach is that no additional electric wires are required and no soldering is required, because this is handled by clicking the lighting system 706 onto the conductor arrangement in the laminate flooring tile 700.

Preferably, the laminate flooring tile 700 comprises connectors that allow multiple tiles to be connected together, in order to connect the power lines between a plurality of laminate flooring tiles. In order to supply power to the lighting system 706, an installer now only needs to make a power connection to one of the laminate flooring tiles, in order to power all laminate flooring tiles in a network. The conductor arrangement may also comprise an additional conductor line which may be used as a data connection to the lighting system 706. The lighting system 706 may comprise a controller for controlling the light output in response to a data signal on the data connection.

The recess 701 may be filled with a light guide, such that the light 707 can be spread even further than a mixing chamber would be able to achieve. The light guide may be a lossy light guide to give a uniform light output, but the light guide may also have light out-coupling sites, in order to make for example a dotted light output pattern.

The floor covering system 10 may be used to show decorative patterns, but may also be used to provide information, such as by providing a light pattern containing information like arrows, commercial information, etc. (see also above).

A person standing or walking on the floor covering system 10, more precisely on the user side 101 of the floor covering 100, is preferably not able to see the lighting system 200 (when in an off state) from above. This may especially be achieved through the relatively low transmission of not more than about 15%, preferably not more than about 10%, such as 5% or lower.

In a further embodiment the floor covering system 10 is used to make an emergency escape route lighting system that may be activated in case of an emergency. The embodiment comprises the floor covering system 10 located on the floor. The floor covering system 10 may comprise a plurality of light sources 205, which may optionally be connected with each other. The light transmissive floor covering (tiles) is (are) used to cover the lighting system 200. The lighting system 200 may for example be arranged to generate light 210 in the shape of light spots, but may also be in the shape of arrows, to point into the right direction for escape. This arrow may also be made variable, such that the direction of the arrow may be changed depending on the location of the emergency. For example, the arrow may point away from a fire hazard. Instead of an arrow, also blinking lights may be used to point into a direction. In this way, also information may be provided, like arrows indicating in a specific direction, commercial information. One or more of colour, pattern shape, on/off state, output intensity, and information content of the light 210 may be variable and may be controlled by the controller.

Further, one or more of colour, pattern shape and information content of the light 210 may be dependent on a sensor signal of a sensor (such as a touch or approach sensor or fire sensor or smoke sensor or thermal sensor, etc.) (not depicted), wherein the sensor is arranged to sense an object on or in the vicinity of the floor covering system 10 or is arranged to sense a feature selected from the group consisting of smoke and heat, and wherein the controller 300 is arranged to control one or more of colour, on/off state, intensity, pattern shape and information content of the light 210 in dependence of the sensor signal.

Optionally, the controller 300 may also control other apparatus, indicated with reference 600, such as other lighting sources. The light 210 may for instance be controlled in response to a sensor signal of one or more sensors 400. One or more of such sensors 400 may for instance be arranged to measure the light level (in a space or room), which light level may for instance at least partly receive a contribution of other light sources, including day light.

The term "substantially" herein, such as in "substantially flat" or in "substantially consists", etc., will be understood by the person skilled in the art. In embodiments the adjective substantially may be removed. Where applicable, the term "substantially" may also include embodiments with "entirely", "completely", "all", etc. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". Likewise, the term about may, where applicable, indicate a deviation of 10% or less, or 5% or less, or 1% or less, or 0.5% or less, or even 0.1% or less, and also in an embodiment no (measureable) deviation. As will be clear to the person skilled in the art, small deviations from numerical values may, where applicable, in general be allowed. Hence, except for the values in the definition of about above, numerical values may, where applicable deviate a 10% or less, or 5% or less, or 1% or less, or 0.5% or less, or even 0.1% or less from the given value. To stress this, herein sometimes the word "about" is used before numerical values.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A floor covering system comprising:

a floor covering layer having a single user side configured to allow transmission of light in the range of 0.5% to 30% and an opposite back side;

an auxiliary layer comprising a first side and an opposite second side, the first side of the auxiliary layer positioned at the back side of the floor covering layer, wherein the auxiliary layer defines a plurality of openings therethrough;

a lighting system layer positioned at the second side of the auxiliary layer and configured to generate light emitted via the user side, wherein the lighting system comprises a plurality of light sources affixed to and extending from a support, wherein the support provides power to the plurality of light sources, and wherein each of the plurality of light sources is positioned entirely within a respective one of the openings in the auxiliary layer to provide a substantially flat lighting system;

a sensor configured to detect an object on or near the floor covering; and a controller in communication with the sensor and arranged to control a parameter of the lighting system in response to detection by the sensor of the object;

wherein the floor covering is chosen from the group consisting of PVC floorings and laminate floorings; and wherein the lighting system is not visible through the floor covering when no light is emitted by the lighting system.

2. The floor covering system according to claim 1, wherein the floor covering is a PVC flooring that comprises a filler material having a refractive index in the range of 1.45 to 1.65.

3. The floor covering system according to claim 1, wherein the floor covering comprises a plurality of floor tiles.

4. A floor tile chosen from the group consisting of PVC flooring tiles and laminate flooring tiles, the floor covering tile comprising:

a first layer comprising a single user face configured to allow transmission of light in the range of 0.5% to 30%, and an opposite back side face;

an auxiliary layer comprising a first side and an opposite second side, the first side of the auxiliary layer positioned at the back side of the floor covering layer, wherein the auxiliary layer defines a plurality of openings therethrough; and a lighting unit layer positioned at the second side of the auxiliary layer and comprising a plurality of light sources affixed to and extending from a support, wherein the support provides power to the plurality of light sources, and wherein each of the plurality of light sources is positioned entirely within a respective one of the openings in the auxiliary layer to provide a substantially flat lighting system;

wherein the lighting unit is not visible from the user face when no light is emitted by the lighting unit.

5. Use of a floor covering system according to claim 1, for way guiding.

* * * * *